US012313304B2

(12) United States Patent
Munk et al.

(10) Patent No.: US 12,313,304 B2
(45) Date of Patent: May 27, 2025

(54) MANAGING CHARGE ALLOCATION AND OPTIMIZING MULTI-MODE PERFORMANCE OF AIR-SOURCE INTEGRATED HEAT PUMPS

(71) Applicant: UT-Battelle, LLC, Oak Ridge, TN (US)

(72) Inventors: Jeffrey D. Munk, Oak Ridge, TN (US); Bo Shen, Oak Ridge, TN (US); Kyle R. Gluesenkamp, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 223 days.

(21) Appl. No.: 18/216,060

(22) Filed: Jun. 29, 2023

(65) Prior Publication Data

US 2024/0011674 A1 Jan. 11, 2024

Related U.S. Application Data

(60) Provisional application No. 63/358,298, filed on Jul. 5, 2022.

(51) Int. Cl.
*F25B 13/00* (2006.01)

(52) U.S. Cl.
CPC .... *F25B 13/00* (2013.01); *F25B 2313/02743* (2013.01); *F25B 2400/0411* (2013.01); *F25B 2400/19* (2013.01)

(58) Field of Classification Search
CPC ..... F25B 13/00; F25B 2313/02743; F25B 2400/0411; F25B 2400/19; F25B 2600/07; F25B 49/02
See application file for complete search history.

(56) References Cited

U.S. PATENT DOCUMENTS 4,299,098 A 11/1981 Derosier
5,653,120 A 8/1997 Meyer
(Continued)

FOREIGN PATENT DOCUMENTS

WO 2013096269 A1 6/2013

OTHER PUBLICATIONS

F. Kuznik, D. David, K. Johannes and J.-J. Roux, "A review on phase change materials integrated in building walls," Renewable and Sustainable Energy Reviews, vol. 15, No. 1, pp. 379-391, 2011.
(Continued)

*Primary Examiner* — Emmanuel E Duke
(74) *Attorney, Agent, or Firm* — WARNER NORCROSS + JUDD LLP

(57) ABSTRACT

An improved heat pump including an integrated system for the management of refrigerant charge is provided. The integrated system actively adjusts charge allocation and thereby optimizes operational efficiencies in all modes of operation. In one embodiment, the integrated system includes three four-way valves, two expansion valves, two one-way check valves, and a suction line accumulator to optimize charge allocation. The four-way valves dictate the mode switch and refrigerant flow directions, and the expansion valves automatically allocate refrigerant mass in active components and store excess charge in an idle heat exchanger and suction line accumulator by controlling the compressor discharge pressure (equivalent to controlling condenser subcooling degree) as a function of the entering air and water temperatures. The integrated system provides seven working modes and is uniquely suited for spacing cooling, spacing heating, and water heating in both residential and commercial applications.

20 Claims, 7 Drawing Sheets

(56) References Cited

U.S. PATENT DOCUMENTS

| | | | | |
|---|---|---|---|---|
| 8,056,348 | B2 | 11/2011 | Murakami et al. | |
| 9,383,126 | B2 | 7/2016 | Chen et al. | |
| 10,168,087 | B2 | 1/2019 | Munk et al. | |
| 2013/0160985 | A1* | 6/2013 | Chen | F25B 13/00 165/201 |
| 2014/0123689 | A1* | 5/2014 | Ellis | F24D 15/04 62/238.7 |
| 2014/0245770 | A1 | 9/2014 | Chen et al. | |
| 2014/0345310 | A1 | 11/2014 | Tamaki et al. | |
| 2016/0313033 | A1* | 10/2016 | Chen | F25B 13/00 |

OTHER PUBLICATIONS

K. Biswas, J. Lu, P. Soroushian and S. Shrestha, "Combined experimental and numerical evaluation of a prototype nano-PCM enhanced wallboard," Applied Energy, vol. 131, pp. 517-529, 2014.

K. O. Lee, M. A. Medina, E. Raith and X. Sun, "Assessing the integration of a thin phase change material (PCM) layer in a residential building wall for heat transfer reduction and management," Applied Energy, vol. 137, pp. 699-706, 2015.

F. Kuznik, J. Virgone and J. Noel, "Optimization of a phase change material wallboard for building use," Applied Thermal Engineering, vol. 28, No. 11-12, pp. 1291-1298, 2008.

S. Álvarez, L. F. Cabeza, A. Ruiz-Pardo, A. Castell and J. A. Tenorio, "Building integration of PCM for natural cooling of buildings," Applied Energy, vol. 109, pp. 514-522, 2013.

P. Hlanze, A. Elhefny, Z. Jiang, J. Cai and H. Shabgard, "In-duct phase change material-based energy storage to enhance building demand flexibility," Applied Energy, vol. 310, p. 118520, 2022.

H. Weinläder, F. Klinker and M. Yasin, "PCM cooling ceilings in the Energy Efficiency Center—passive cooling potential of two different system designs," Energy and Buildings, vol. 119, pp. 93-100, 2016.

S. Mousavi, B. Rismanchi, S. Brey and L. Aye, "PCM embedded radiant chilled ceiling: A state-of-the-art review," Renewable and Sustainable Energy Reviews, vol. 151, p. 111601, 2021.

A. de Gracia, C. Fernández, A. Castell, C. Mateu and L. F. Cabeza, "Control of a PCM ventilated facade using reinforcement learning techniques," Energy and Buildings, vol. 106, pp. 234-242, 2015.

M. Fiorentini, J. Wall, Z. Ma, J. H. Braslavsky and p. Cooper, "Hybrid model predictive control of a residential HVAC system with on-site thermal energy generation and storage," Applied Energy, vol. 187, pp. 465-479, 2017.

G. Serale, M. Fiorentini, A. Capozzoli, P. Cooper and M. Perino, "Formulation of a model predictive control algorithm to enhance the performance of a latent heat solar thermal system," Energy Conversion and Management, vols. 438-449, p. 173, 2018.

G. Gholamibozanjani, J. Tarragona, A. de Gracia, C. Fernández, L. F. Cabeza and M. M. Farid, "Model predictive control strategy applied to different types of building for space heating," Applied Energy, vol. 231, pp. 959-971, 2018.

C. R. Touretzky and M. Baldea, "A hierarchical scheduling and control strategy for thermal energy storage systems," Energy and Buildings, vol. 110, pp. 94-107, 2016.

J. Cai and J. Braun, "An inverse hygrothermal model for multi-zone buildings," Journal of Building Performance Simulation, vol. 9, No. 5, pp. 510-528, 2016.

B. Shen, J. New and V. Baxter, "Air source integrated heat pump simulation model for EnergyPlus," Energy and Buildings, vol. 156, pp. 197-206, 2017.

* cited by examiner

MANAGING CHARGE ALLOCATION AND OPTIMIZING MULTI-MODE PERFORMANCE OF AIR-SOURCE INTEGRATED HEAT PUMPS

CROSS-REFERENCE TO RELATED APPLICATIONS

This application claims the benefit of U.S. Provisional Application 63/358,298, filed Jul. 5, 2022, the disclosure of which is incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

FIELD OF THE INVENTION

The present invention relates to heat pumps, and in particular, the management of refrigerant charge in air-source integrated heat pumps.

BACKGROUND OF THE INVENTION

Air-source integrated heat pumps (ASIHPs) are multi-functional and are capable of providing space cooling, space heating, domestic water heating, and energy storage. ASIHPs have many working modes and tend to include a variable-speed or multi-speed compressor, two air-to-refrigerant heat exchangers, and a water-to-refrigerant heat exchanger. In some working modes, however, one or more of the heat exchangers are unused. In addition, it can be difficult to allocate refrigerant charges between the active and inactive heat exchanger and it can be difficult to optimize the active system charge as needed for individual working modes.

More specifically, a first known heat pump includes two four-way valves and two electronic expansion valves to manage charge collection. This conventional configuration can only perform water heating in a full condensing mode, and not in desuperheating or parallel condensing modes, which limits the capacity of the heating operation when the source water or air temperature is low. A second known heat pump includes a three-way solenoid valve to alter the mode between an air-to-refrigerant condenser and a water-to-refrigerant condenser. This configuration can run water heating in either desuperheating or full condensing modes. However, this configuration requires a special charge migration operation to allocate the charge when changing the operation mode and condenser. This disrupts the comfort level and quick response comfort demands. Additionally, in the case of when the water heater is not used, the water-to-refrigerant heat exchanger causes an extra pressure drop at the compressor discharge side and degrades operational efficiencies in other modes of operation.

Accordingly, there remains a continued need for the improved management of refrigerant charge in heat pumps, and in particular, the optimized performance of ASIHPs.

SUMMARY OF THE INVENTION

An improved heat pump including an integrated system for the management of refrigerant charge is provided. The integrated system actively adjusts charge allocation and thereby optimizes operational efficiencies in all modes of operation. In one embodiment, the integrated system includes three four-way valves, two electronic expansion valves, two one-way valves, and a suction line accumulator to optimize charge allocation in individual modes of an ASIHP. The four-way valves dictate the mode switch and refrigerant flow directions. The electronic expansion valves automatically allocate refrigerant mass in active components and store excess charge in an idle heat exchanger and suction line accumulator by controlling the compressor discharge pressure, equivalent to controlling the condenser exit sub-cooling degree, as a function of the entering air and water temperatures. The integrated system provides seven working modes to simultaneously provide good energy efficiency and comfort. The integrated system does not require a special charge migration operation and completes a mode transfer operation by moving a refrigerant mass from one condenser to another condenser smoothly. The integrated system also maximizes the flexibility of water heating, including desuperheating, full condensing, and parallel condensing. This and other embodiments are uniquely suited for residential space cooling, space heating, and water heating, as well as commercial applications with high water heating and space cooling demands, such as restaurants, hotels, and hospitals.

These and other features and advantages of the present invention will become apparent from the following description of the invention, when viewed in accordance with the accompanying drawings and appended claims.

DETAILED DESCRIPTION OF THE CURRENT EMBODIMENT

The current embodiment relates to a heat pump including an integrated system for the management of refrigerant charge. The integrated system actively adjusts charge allocation and thereby optimizes operational efficiencies across seven modes of operation, including space cooling, space heating, dedicated water heating, combined space cooling with water heating in full condensing, combined space cooling and water heating in desuperheating, combined space heating and water heating in parallel condensing, and combined space heating and water heating in desuperheating. Before the modes of operation are discussed, the physical configuration of the heat pump and the integrated system are set forth below in connection with FIG. 1.

Figure 1:
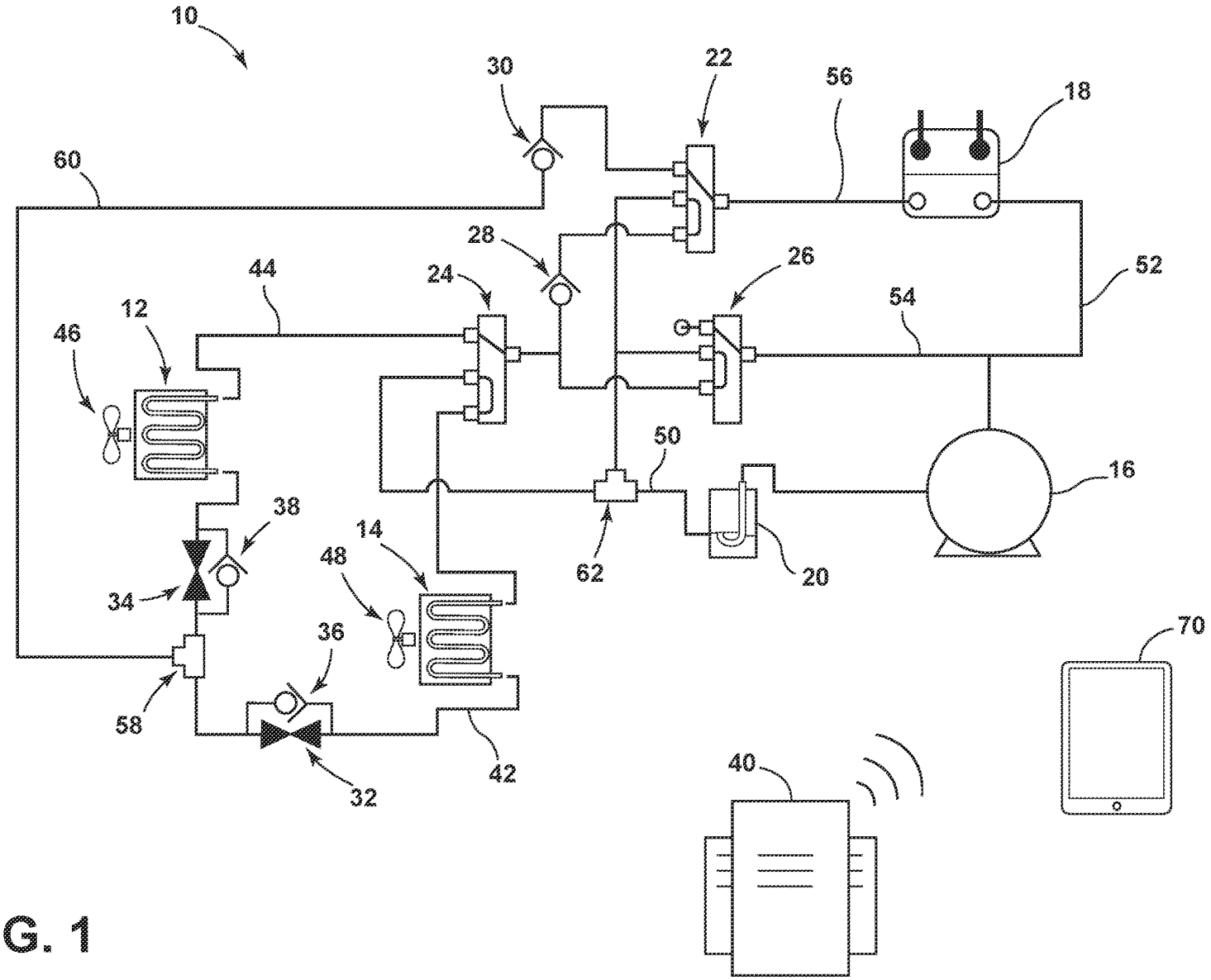
FIG. 1 is a schematic diagram of a heat pump and integrated charge management system in accordance with a current embodiment.

In particular, a heat pump in accordance with one embodiment is shown in FIG. 1 and generally designated 10. The heat pump 10 includes an indoor heat exchanger 12, an outdoor heat exchanger 14, a compressor 16, a water-to-refrigerant heat exchanger 18, a suction line accumulator 20, and an integrated charge management system. The integrated charge management system includes a first four-way reversing valve 22, a second four-way reversing valve 24, a third four-way reversing valve 26, a first one-way check valve 28, a second one-way check valve 30, a first expansion valve 32, and a second expansion valve 34. Each expansion valve 32, 34 is parallel connected to a respective check valve 36, 38. The integrated charge management system also includes control circuitry (or controller module) 40, for example a processor, communicatively coupled with the four-way reversing valves 22, 24, 26 and the expansion valves 32, 34 to selectively configure the four-way reversing valves and the expansion valves and to cause the heat pump 10 to be operative across each of the seven modes of operation introduced above.

More specifically, the outdoor heat exchanger 14 and the first expansion valve 32 are series connected along an outdoor line 42, while the indoor heat exchanger 12 and the second expansion valve 34 are series connected along an indoor line 44. The outdoor line 42 and the indoor line 44 include any enclosed passageway through which refrigerant flows or can flow. The heat exchangers 12, 14 can include any construction adapted to transfer heat between a first medium (e.g., refrigerant) and a second medium (e.g., air). In one embodiment, the heat exchanges 12, 14 each include a fan 46, 48 to direct the flow of air over a coil.

The outdoor line 42 and the indoor line 44 are each coupled to the second reversing valve 24. The compressor 16 and the suction line accumulator 20 are series connected to a compressor suction line 50, which also extends from the second reversing valve 24. The output of the compressor 16 flows through two parallel discharge lines: a first compressor discharge line 52 and a second compressor discharge line 54. The first compressor discharge line 52 is coupled to the air-to-water heat exchanger 18, for example a brazed plate heat exchanger, and the second compressor discharge line 54 is coupled to the third reversing valve 26. The output of the heat exchanger 18 is coupled along a water heater discharge line 56 to the first reversing valve 22.

Each reversing valve 22, 24, 26 can selectively control the flow of refrigerant between four ports. In some embodiments, the reversing valves 22, 24 26 are operated by an electromechanical solenoid that is movable between two positions. The first reversing valve 22 includes a first output coupled to a first T-junction 58 via a first supply line 60. The second check valve 30 is coupled between the first reversing valve 22 and the first T-junction 58 to prevent the reverse flow of refrigerant through the first supply line 60. The first reversing valve 22 also includes a second output coupled to the second and third reversing valves 24, 26 via the first check valve 28 and includes a third output coupled to the compressor suction line 50 at a T-junction 62.

Further with respect to the first reversing valve 22, this valve couples the output of the water-to-refrigerant heat exchanger 18 to either of the first T-junction 58 (in a water heating mode) or a second T-junction 62 (in a space heating mode). With respect to the second reversing valve 24, this valve couples the output of the indoor heat exchanger 12 to either of the compressor 16 (in a space cooling mode) or couples the output of the outdoor heat exchanger 14 to the compressor 16 (in a space heating mode). With respect to the third reversing valve 26, this valve couples the output of the compressor 16 to the second reversing valve 24 or shunts the second compressor discharge line 54, such that the compressor 16 only outputs to the water-to-refrigerant heat exchanger 18.

The heat pump and integrated charge management system is a multi-functional unit, capable of meeting home comfort requests, including space cooling, space heating, domestic water heating, and energy storage. The configuration shown in FIG. 1 can actively adjust charge allocation and thus optimize operational efficiencies across all operation modes. The reversing valves 22, 24, 26 switch among the operation modes and control refrigerant flow directions, while the expansion valves 32, 34 allocate refrigerant mass in active components. Excess charge is stored in an idle heat exchanger and the suction line accumulator.

Figure 2:
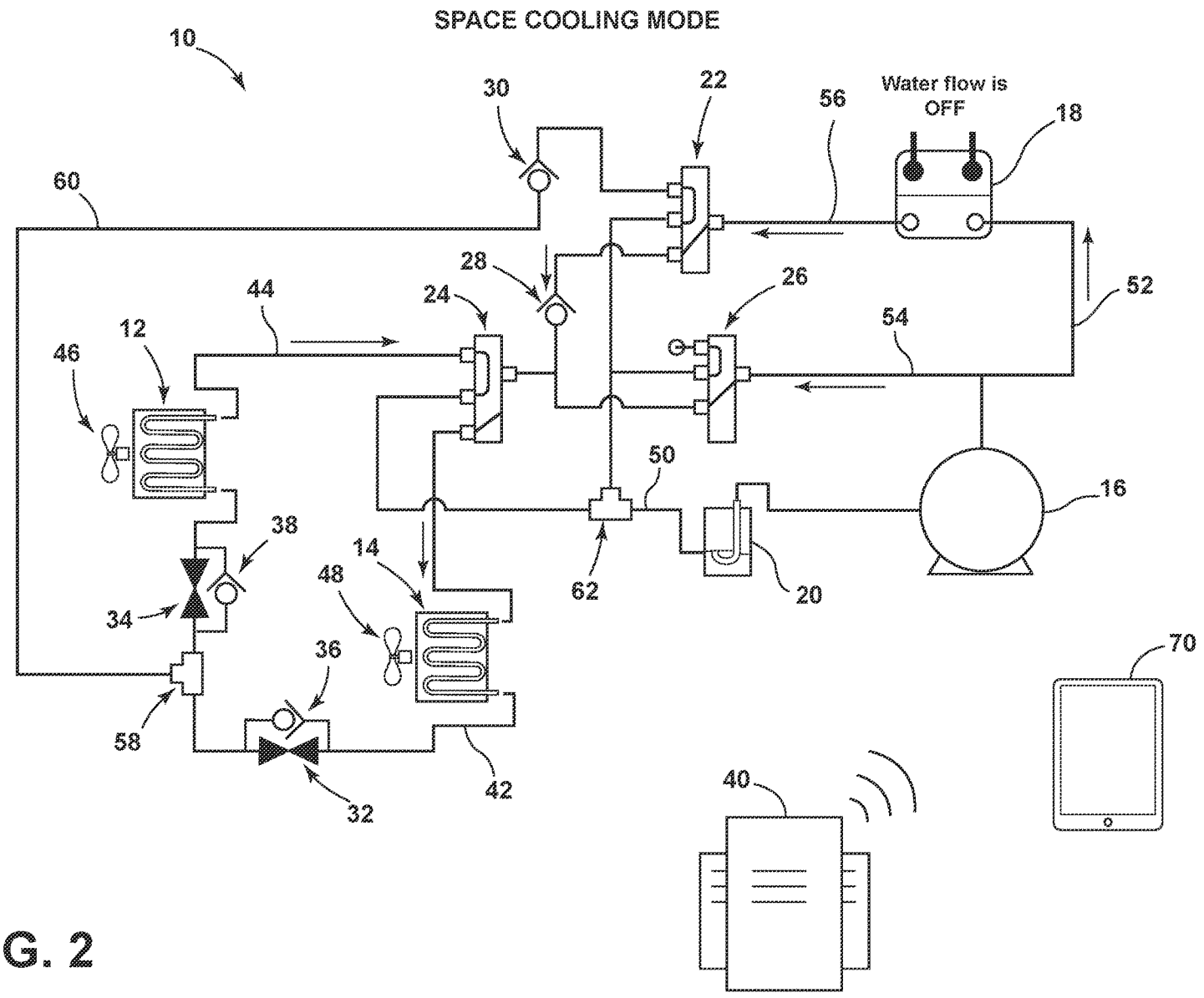
FIG. 2 illustrates the heat pump of FIG. 1 in a dedicated space cooling mode of operation.

Operation of the heat pump across the seven modes of operation will now be described. In a dedicated space cooling mode, shown in FIG. 2, the compressor mass flow is routed through parallel discharge lines: the first compressor discharge line 52 and the second compressor discharge line 54. The compressor mass flow merges at the inlet to the second reversing valve 24. High pressure refrigerant gas from the compressor 40 is routed to the outdoor heat exchanger 14, where the refrigerant gas is condensed. The condensed refrigerant is directed to the indoor heat exchanger 12, where the condensed refrigerant is evaporated by heat exchange with the space to be cooled. Refrigerant returns to the compressor 16 at low pressure. During this mode of operation, the water flow in the water-to-refrigerant heat exchanger 18 is OFF, and the indoor blower 46 and the outdoor fan 48 are ON. The water-to-refrigerant heat exchanger 18 becomes a parallel flow path to the discharge line, which reduces flow resistance. The first expansion valve 32 is fully open, while the second expansion valve 34 controls the superheat degree exiting the coil of the indoor heat exchanger 12.

Figure 3:
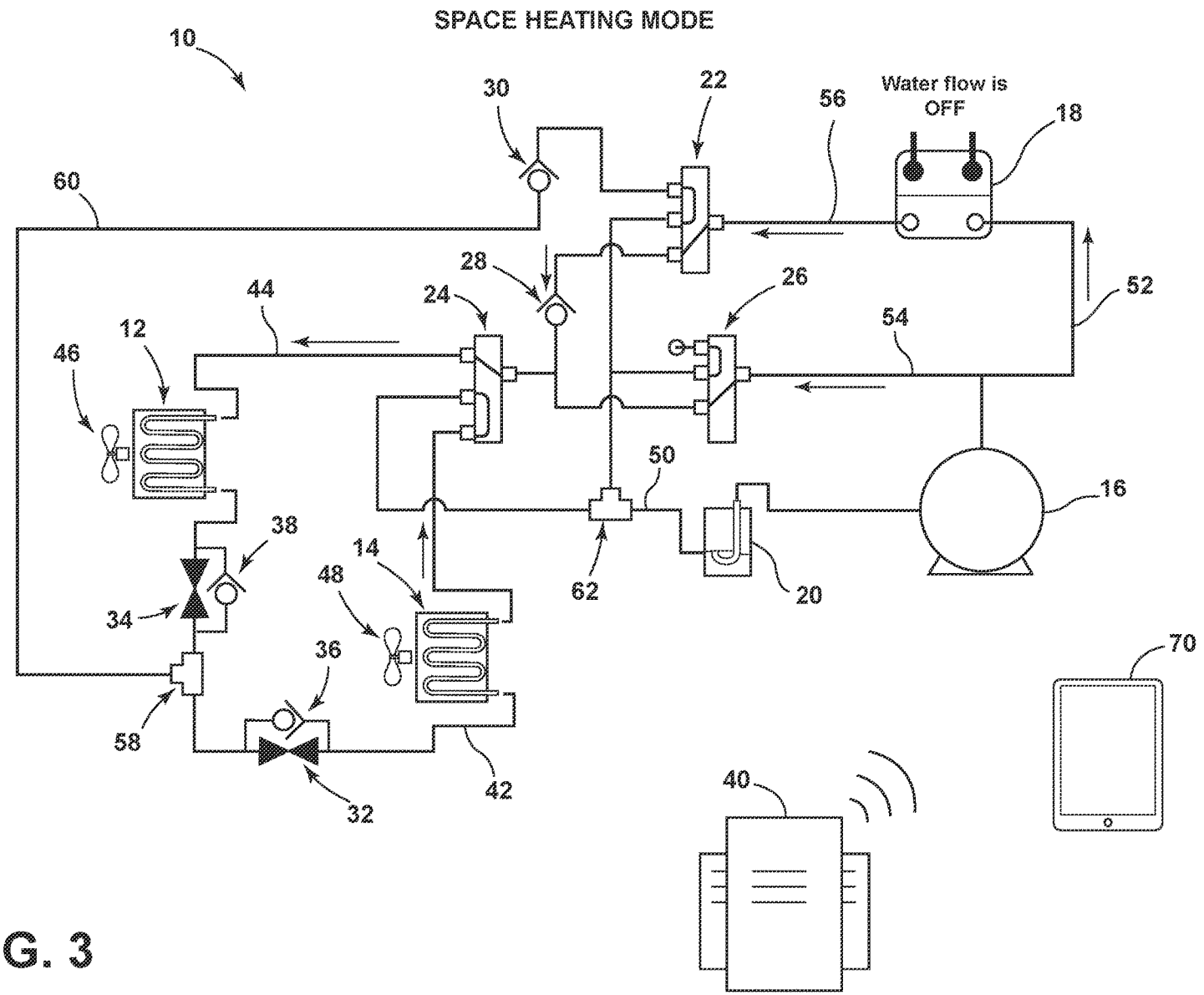
FIG. 3 illustrates the heat pump of FIG. 1 in a dedicated space heating mode of operation.

In a dedicated space heating mode, shown in FIG. 3, the compressor mass again flows through the first compressor discharge line 52 and the second compressor discharge line 54. The compressor mass flow merges at the inlet to the second reversing valve 24. The indoor heat exchanger 12 serves as a condenser, and the outdoor heat exchanger 14 serves as an evaporator. The refrigerant returns to the compressor 16 through the compressor suction line 50. The supply line 60 is blocked by the second one-way check valve 30. In this mode of operation, the water flow in the water-to-refrigerant heat exchanger 18 is OFF, and the indoor blower 46 and the outdoor fan 48 are ON. The second expansion valve 34 is fully open, while the first expansion valve 32 controls an optimum subcooling degree exiting the indoor coil. The subcooling degree adjusts excessive charge stored in the suction line accumulator 20 and optimizes active charge in the system.

Figure 4:
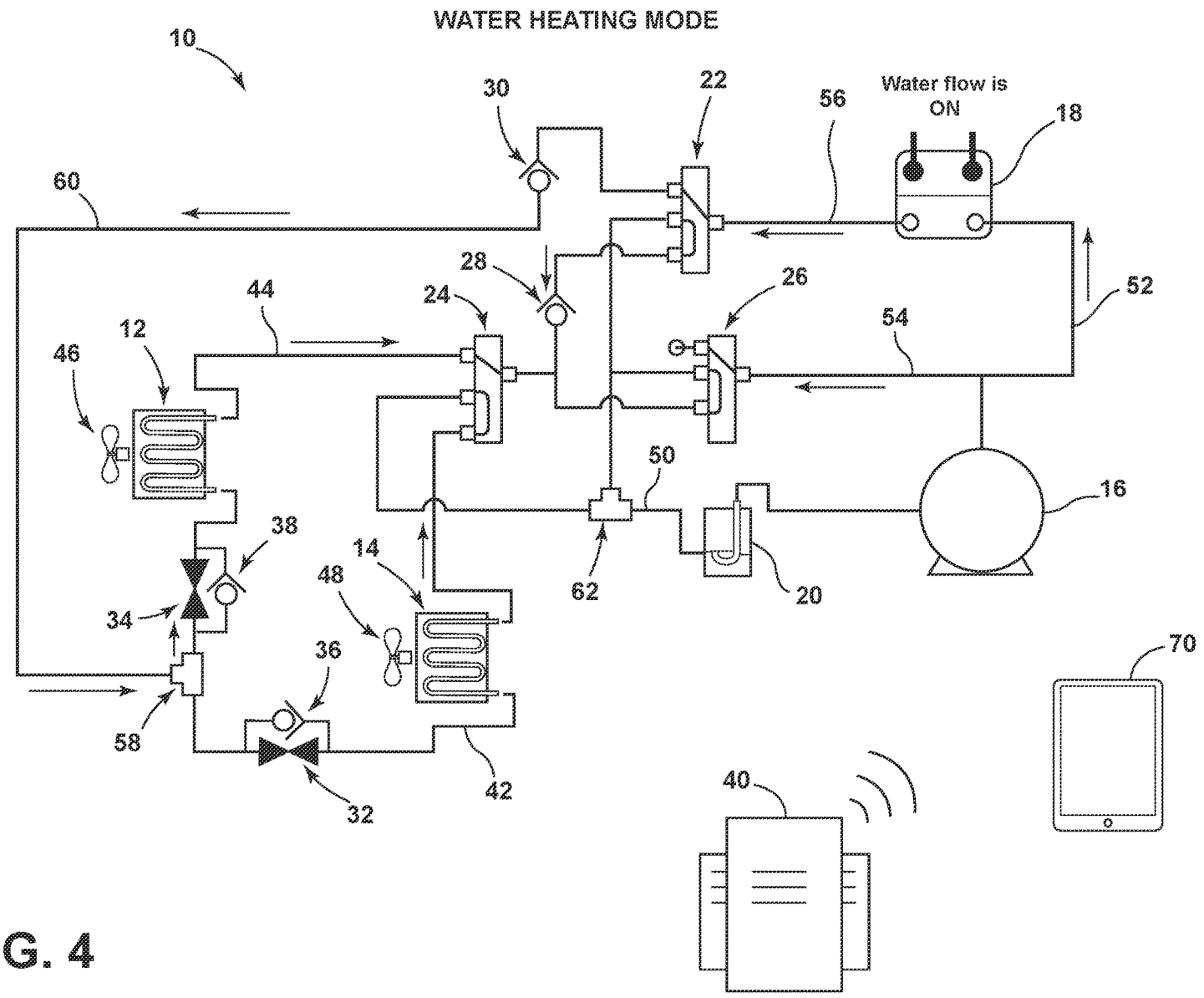
FIG. 4 illustrates the heat pump of FIG. 1 in a dedicated water heating mode of operation.

In a dedicated water heating mode, as shown in FIG. 4, an outdoor air source is used for water heating. The compressor mass flow is routed through the first compressor discharge line 52 and through the water-to-refrigerant heat exchanger 18. The first reversing valve 22 routes the refrigerant through the first supply line 69 to the first T-junction 58. The refrigerant is then routed through the first expansion valve 32 and the coil of the outdoor heat exchanger 14, returning to the suction side of the compressor 16 via the second reversing valve 24. In this mode, the water flow (that is, the water being heated by the compressor flow mass) through the water-to-refrigerant heat exchanger 18 is ON. The indoor blower 46 is OFF, but the outdoor fan 48 is ON. The second expansion valve 34 is fully closed, and the first expansion valve 32 is modulated to achieve an optimum subcooling degree.

Figure 5:
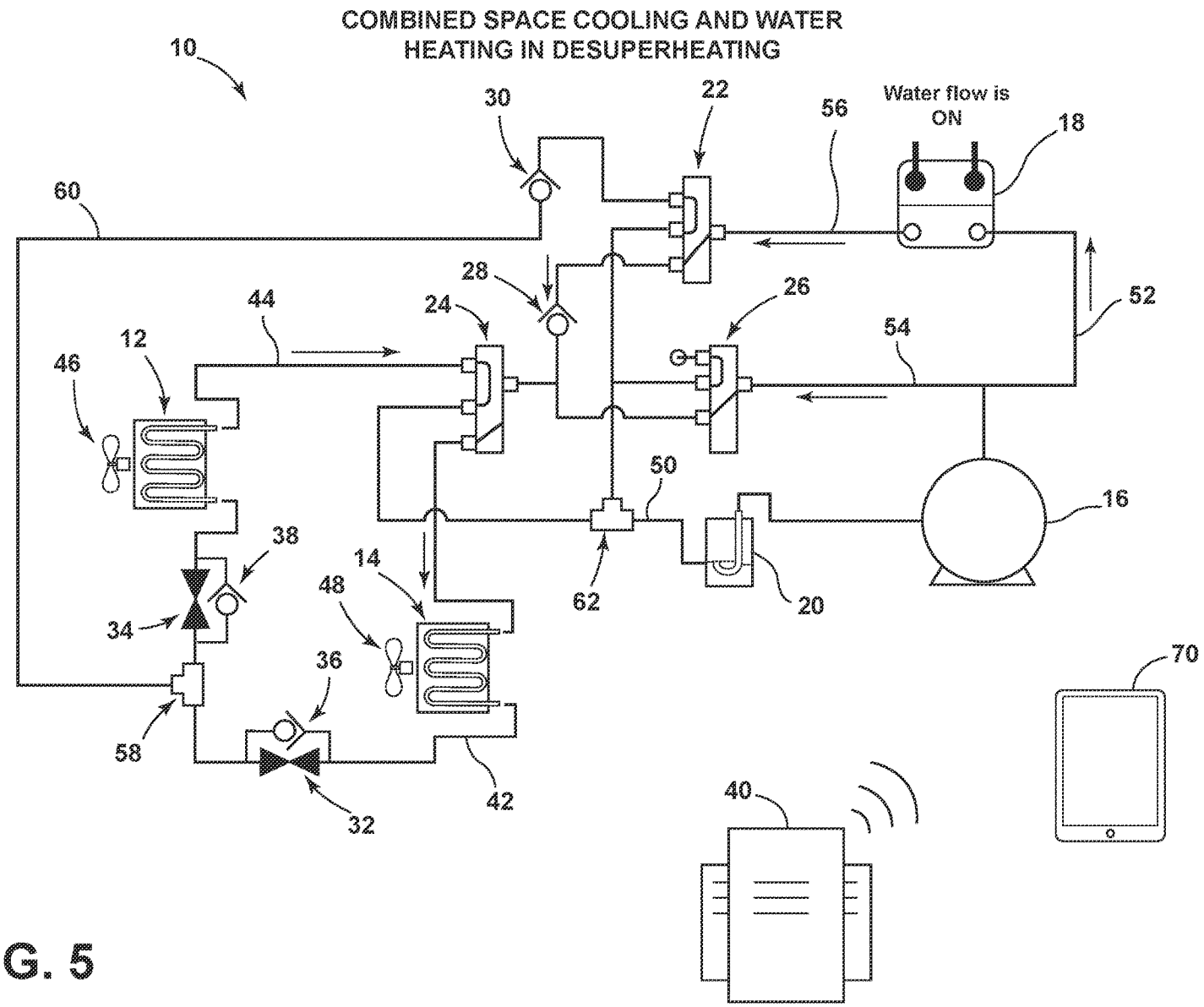
FIG. 5 illustrates the heat pump of FIG. 1 in a combined space cooling and water heating (desuperheating) mode of operation.

As noted previously, there exists two combined space cooling and water heating modes of operation: (1) water heating in full condensing and (2) water heating in desuperheating. In a water heating in full condensing mode of operation, water flow in the water-to-refrigerant heat exchanger 18 is ON. The refrigerant flow path is identical to the dedicated water heating mode of operation as depicted in FIG. 4. However, the air flow paths and the expansion valves operate differently. In particular, the indoor blower 46 is ON, while the outdoor fan 48 is OFF. The second expansion valve 34 controls a target superheat degree at the indoor evaporator exit, while the first expansion valve 32 controls an optimum subcooling degree. The first expansion valve 32 manages the excessive charge located in the outdoor coil (i.e., the coil of the outdoor heat exchanger 14) and located in the suction line accumulator 20. This mode is best suited for a simultaneous demand for space cooling and water heating. The second combined mode (water heating in desuperheating) is instead best suited for a single demand for space cooling. In this mode of operation, shown in FIG. 5, the return water temperature at the tank bottom should be higher than the condensing temperature resulted by the space cooling operation, but lower than the compressor discharge temperature. The flow path and operation are the same as in the space cooling mode of FIG. 2, while just having the water flow through the water-to-refrigerant heat exchanger 18 ON. Both the indoor blower 46 and the outdoor blower 48 are ON. The first expansion valve 32 is fully open, while the second expansion valve 34 controls the superheat degree at the indoor evaporator exit. This mode of operation uses free desuperheater heat to slow heat up the tank water without interrupting the major space cooling operation. This mode is allowed when the tank top temperature is below a predetermined setting (e.g., 140° F.), and the tank bottom temperature is below the compressor discharge temperature.

Figure 6:
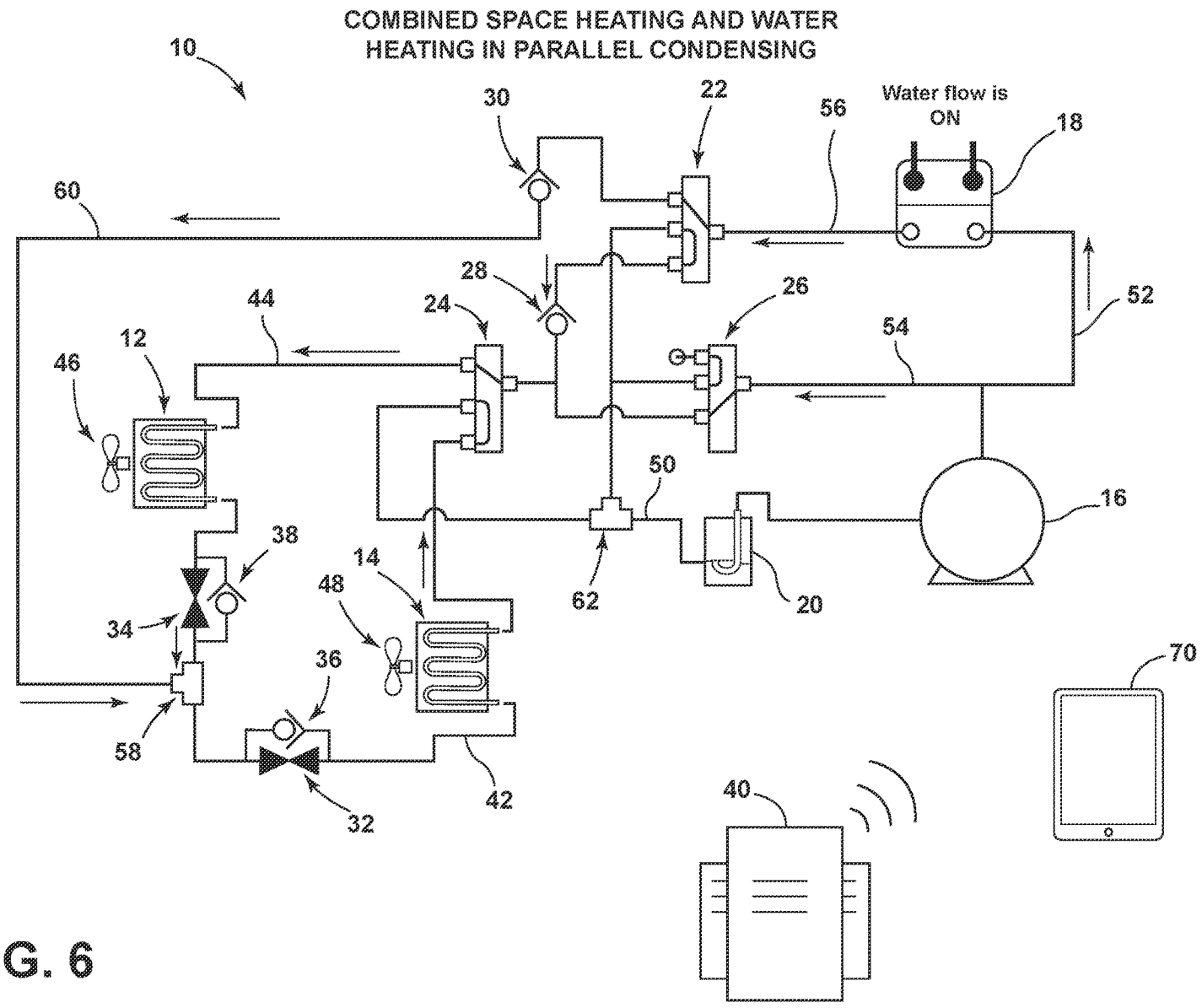
FIG. 6 illustrates the heat pump of FIG. 1 in a combined space heating and water heating (parallel condensing) mode of operation.
Figure 7:
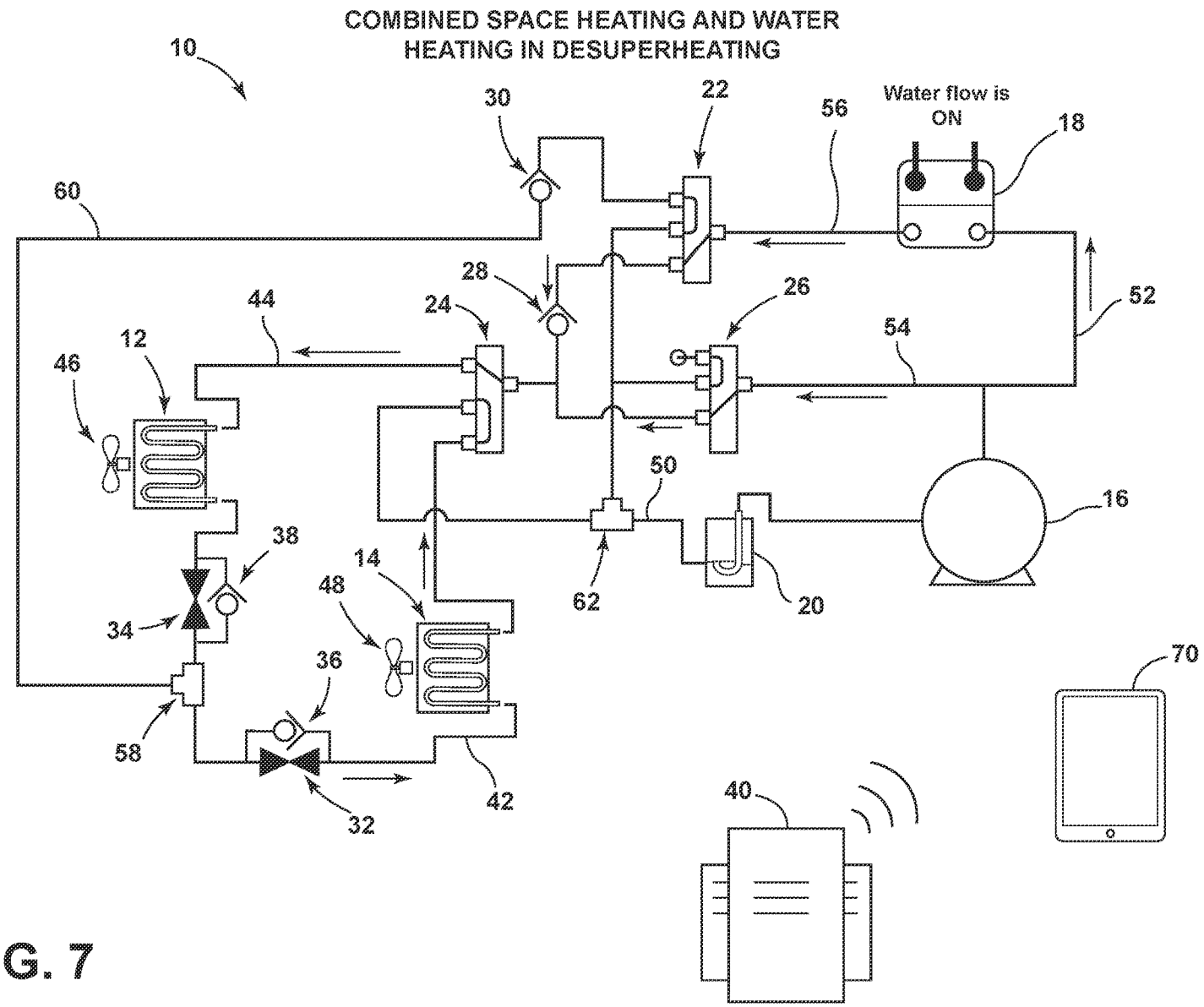
FIG. 7 illustrates the heat pump of FIG. 1 in a combined space heating and water heating (desuperheating) mode of operation.

In addition to the foregoing, the heat pump 10 provides two modes of operation that combine space heating with water heating: (1) water heating in parallel condensing (FIG. 6) and (2) water heating in desuperheating (FIG. 7). Referring first to FIG. 6, the combined space heating and water heating in parallel condensing is best suited for simultaneous demands for space heating and water heating. In this mode of operation, the return water temperature should be less than a predetermined set point temperature, for example 70° F. The refrigerant flow path for water heating includes the compressor 16, the first compressor discharge line 52, the water-to-refrigerant heat exchanger 18, the water heater discharge line 56, the first reversing valve 30, and the first supply line 60. The refrigerant flow path for space heating flows through the second compressor discharge line 54, the third reversing valve 26, the indoor line 44. The water heating and space cooling flow paths merge at the first T-junction 60, and the refrigerant therein is expanded in the first expansion valve 32. The outdoor coil is functionally an evaporator coil in this mode of operation, and the refrigerant returns to the compressor 16 through the second reversing valve 24. The water flow through the water-to-refrigerant heat exchanger 18 is ON, and both of the indoor fan 46 and the outdoor blower 48 are ON. The second expansion valve 34 is fully open, and the first expansion valve 32 is modulated by the controller circuitry 40 to maintain the discharge saturation temperature within a predetermined temperature range, for example 95° F. to 100° F. Throughout this mode of operation, the compressor 16 runs at top speed to meet space heating and water heating demands.

The combined space heating and water heating in desuperheating mode of operation is illustrated in FIG. 7. This mode responds to a demand for space heating, regardless of whether there is a demand for water heating. The return temperature, that is, the tank bottom temperature, should be above a minimum set point, for example 80° F., but below a maximum set point, for example 140° F. The refrigerant flow path is identical to that of the space heating mode of operation, shown in FIG. 3, but the water flow through the water-to-refrigerant heat exchanger 18 is ON. Both of the indoor blower 46 and the outdoor fan 48 are ON. The second expansion valve 34 is fully open, and the first expansion valve 32 is modulated by the controller circuitry 40 to control the optimum subcooling degree. Throughout this mode of operation, the compressor 16 runs at top speed to meet space heating and water heating demands.

The control circuitry 40 is communicatively coupled with the four-way reversing valves 22, 24, 26 and the electronic expansion valves 32, 34 to selectively configure the four-way reversing valves 22, 24, 26 and the electronic expansion valves 32, 34 and to cause the heat pump to operate across each of the seven modes of operation described above. Generally, the control circuitry 40 selects among the seven available modes of operation based on the existing heating and/or cooling demand(s). The control circuitry 40 alters the flow direction by, first, modulating the third reversing valve 26, second, modulating the first reversing valve 22, and, third, modulating the second reversing valve 24. When switching from the dedicated spacing cooling mode to the space cooling and water heating mode, there can sometimes exist a mismatch as between control behaviors among the two expansion valves 32, 34. By holding the first expansion valve 32 at a fixed opening position for a minimum time period before starting subcooling degree control, for example 30 seconds, this mismatch can be minimized.

The control circuitry 40 actively adjusts charge allocation and thus optimizes the operating efficiency across all operating modes. In particular, the control circuitry 40 is communicatively coupled a user interface 70, for example a tablet or a smartphone, that is configured to receive a user selection of any one of the plurality of functional modes. The control circuitry 49 is also communicatively coupled with the first, second, and third four-way reversing valves 22, 24, 26 and the first and second expansion valves 32, 34 to selectively configure, during operation of the heat pump 10, the first, second, and third four-way reversing valves 22, 24, 26 and the first and second expansion valves 32, 34 to cause the multi-functional system to provide any one of dedicated space cooling, dedicated space heating, dedicated water heating, combined water and space heating, or combined water heating and space heating based on the user selection. The reversing valves 22, 24, 26 dictate mode switches and refrigerant flow directions, while the expansion valves 32, 34 automatically allocate refrigerant mass in active components and store excess charge in an idle heat exchanger and suction line accumulator 20 by controlling the compressor discharge pressure as a function of the entering air and water temperatures.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A charge management system for a heat pump including a compressor, an indoor air-to-refrigerant heat exchanger, an outdoor air-to-refrigerant heat exchanger, and a water-to-refrigerant heat exchanger, wherein a delivery port of the compressor is fluidly coupled to a refrigerant inlet port of the water-to-refrigerant heat exchanger, the charge management system comprising:

a first four-way reversing valve fluidly coupled between a refrigerant outlet port of the water-to-refrigerant heat exchanger and an intake port of the compressor;

a first one-way check valve fluidly coupled to the first four-way reversing valve;

a second four-way reversing valve fluidly coupled to the indoor air-to-refrigerant heat exchanger, the outdoor air-to-refrigerant heat exchanger, the first one-way check valve, and the intake port of the compressor;

a third four-way reversing valve fluidly coupled to the delivery port of the compressor, the second four-way reversing valve, and the first one-way check valve, and the intake port of the compressor;

a second one-way check valve fluidly coupled to the first four-way reversing valve;

a first expansion valve fluidly coupled in line with the outdoor air-to-refrigerant heat exchanger;

a second expansion valve fluidly coupled in line with the indoor air-to-refrigerant heat exchanger; and controller circuitry communicatively coupled with the first, second, and third four-way reversing valves and the first and second expansion valves to selectively configure the first, second, and third four-way reversing valves and the first and second expansion valves to cause the heat pump to provide a plurality of functional modes including dedicated space cooling, dedicated space heating, dedicated water heating, combined space cooling and water heating, and combined space heating and water heating.

2. The charge management system of claim 1, wherein the controller circuitry is communicatively coupled to a user interface that is configured to receive a user selection of any one of the plurality of functional modes.

3. The charge management system of claim 1, wherein the controller circuitry is adapted to configure the heat pump in the dedicated space cooling functional mode by routing refrigerant from the compressor first to the outdoor air-to-refrigerant heat exchanger and subsequently to the indoor air-to-refrigerant heat exchanger, with the first expansion valve being fully open, the second expansion valve being at least partially open, and no water flowing through the water-to-refrigerant heat exchanger.

4. The charge management system of claim 1, wherein the controller circuitry is adapted to configure the heat pump in the dedicated space heating functional mode by routing refrigerant from the compressor first to the indoor air-to-refrigerant heat exchanger and subsequently to the outdoor air-to-refrigerant heat exchanger, with the first expansion valve being at least partially open, the second expansion valve being fully open, and no water flowing through the water-to-refrigerant heat exchanger.

5. The charge management system of claim 1, wherein the controller circuitry is adapted to configure the heat pump in the dedicated water heating functional mode by routing refrigerant from the compressor first through the water-to-refrigerant heat exchanger and subsequently through the outdoor air-to-refrigerant heat exchanger, wherein the first expansion valve is at least partially open, wherein the second expansion valve is fully closed, and wherein a supply of water being heated flows through the water-to-refrigerant heat exchanger.

6. The charge management system of claim 1, wherein the controller circuitry is adapted to configure the heat pump in the combined space cooling and water heating functional mode, with full condensing, by routing refrigerant from the compressor first through the water-to-refrigerant heat exchanger and subsequently through the outdoor air-to-refrigerant heat exchanger, wherein a supply of water being heated flows through the water-to-refrigerant heat exchanger, and wherein a blower of the indoor air-to-refrigerant heat exchanger is ON and a fan of the outdoor air-to-refrigerant heat exchanger is OFF.

7. The charge management system of claim 1, wherein the controller circuitry is adapted to configure the heat pump in the combined space cooling and water heating functional mode, with desuperheating, by routing refrigerant from the compressor first to the water-to-refrigerant heat exchanger and subsequently the outdoor air-to-refrigerant heat exchanger and the indoor air-to-refrigerant heat exchanger, with the first expansion valve being fully open, the second expansion valve being at least partially open, wherein a supply of water being heated flows through the water-to-refrigerant heat exchanger.

8. The charge management system of claim 1, wherein the controller circuitry is adapted to configure the heat pump in the combined space heating and water heating functional mode, with parallel condensing, by routing refrigerant from the compressor through the water-to-refrigerant heat exchanger in parallel with refrigerant being routed through the indoor air-to-refrigerant heat exchanger, wherein a supply of water being heated flows through the water-to-refrigerant heat exchanger, and wherein the first expansion valve is at least partially open and the second expansion valve is fully open, with refrigerant from the water-to-refrigerant heat exchanger bypassing the indoor air-to-refrigerant heat exchanger.

9. The charge management system of claim 1, wherein the controller circuitry is adapted to configure the heat pump in the combined space heating and water heating functional mode, with desuperheating, by routing refrigerant from the compressor through the water-to-refrigerant heat exchanger in parallel with refrigerant being routed through the indoor air-to-refrigerant heat exchanger, wherein a supply of water being heated flows through the water-to-refrigerant heat exchanger, wherein the first expansion valve is at least partially open and wherein the second expansion valve is fully open, with refrigerant from the water-to-refrigerant heat exchanger being routed through the indoor air-to-refrigerant heat exchanger.

10. The charge management system of claim 1, wherein the controller circuitry is configured to sequentially alter flow directions first in the third four-way reversing valve, second in the first four-way reversing valve, and third in the second four-way reversing valve.

11. The charge management system of claim 1, wherein the controller circuitry is configured to hold the first expansion valve at a fixed open position for a minimum time period before commencing discharge pressure control.

12. The charge management system of claim 1, wherein the first and second expansion valves are electronic expansion valves.

13. The charge management system of claim 1, wherein the water-to-refrigerant heat exchanger includes a brazed plate water heater.

14. A heat pump comprising:

a compressor configured to compress a refrigerant;

a water-to-refrigerant heat exchanger configured to receive the refrigerant from the compressor for heating a supply of water;

an indoor air-to-refrigerant heat exchanger configured to receive the refrigerant from the water-to-refrigerant heat exchanger along an indoor line;

an outdoor air-to-refrigerant heat exchanger configured to receive the refrigerant from the water-to-refrigerant heat exchanger along an outdoor line;

a first reversing valve in fluid communication with the water-to-refrigerant heat exchanger, wherein the first reversing valve selectively couples the water-to-refrigerant heat exchanger to either of the outdoor air-to-refrigerant heat exchanger or to a T-junction between the indoor air-to-refrigerant heat exchanger and the outdoor air-to-refrigerant heat exchanger;

a second reversing valve in fluid communication with the first reversing valve, wherein the second reversing valve selectively couples the first reversing valve to either of the indoor air-to-refrigerant heat exchanger or the outdoor air-to-refrigerant heat exchanger;

a third reversing valve in fluid communication with the compressor, wherein the third reversing valve selectively couples the compressor to the second reversing valve;

a controller module communicatively coupled with the first reversing valve, the second reversing valve, the third reversing valve for selectively routing the refrigerant from a discharge side of the compressor to the indoor air-to-refrigerant heat exchanger, the outdoor air-to-refrigerant heat exchanger, and the water-to-refrigerant heat exchanger.

15. The heat pump of claim 14, further comprising a suction line accumulator coupled directly with a suction side of the compressor.

16. The heat pump of claim 14, wherein the water-to-refrigerant heat exchanger comprises a brazed plate water heater.

17. The heat pump of claim 14, wherein each of the indoor air-to-refrigerant heat exchanger and the outdoor air-to-refrigerant heat exchanger comprise a coil and a fan.

18. The heat pump of claim 14, wherein the outdoor air-to-refrigerant heat exchanger and a first expansion valve are in fluid communication with each other along the outdoor line.

19. The heat pump of claim 18, wherein the indoor air-to-refrigerant heat exchanger and a second expansion valve are in fluid communication with each other along the indoor line.

20. The heat pump of claim 19, wherein each of the outdoor line and the indoor line are coupled to the T-junction for receiving refrigerant from the water-to-refrigerant heat exchanger.

* * * * *